US011371107B2

(12) United States Patent
Grosse Lordemann

(10) Patent No.: US 11,371,107 B2
(45) Date of Patent: Jun. 28, 2022

(54) METHOD FOR COOLING A METALLIC ITEM AND COOLING BAR

(71) Applicant: SMS GROUP GMBH, Dusseldorf (DE)

(72) Inventor: Frederik Grosse Lordemann, Heiligenhaus (DE)

(73) Assignee: SMS GROUP GMBH, Duesseldorf (DE)

( * ) Notice: Subject to any disclaimer, the term of this patent is extended or adjusted under 35 U.S.C. 154(b) by 0 days.

(21) Appl. No.: 16/764,766

(22) PCT Filed: Nov. 15, 2018

(86) PCT No.: PCT/EP2018/081292
§ 371 (c)(1),
(2) Date: May 15, 2020

(87) PCT Pub. No.: WO2019/101610
PCT Pub. Date: May 31, 2019

(65) Prior Publication Data

US 2020/0362427 A1 Nov. 19, 2020

(30) Foreign Application Priority Data

Nov. 22, 2017 (DE) ..... 102017220891.0

(51) Int. Cl.
*C21D 1/667* (2006.01)
*C21D 1/18* (2006.01)
*C22F 1/00* (2006.01)

(52) U.S. Cl.
CPC ..... *C21D 1/667* (2013.01); *C21D 1/18* (2013.01); *C22F 1/002* (2013.01)

(58) Field of Classification Search
CPC ..... C21D 1/667; C21D 1/18; C22F 1/002; B21B 45/0233; B21B 45/0218
See application file for complete search history.

(56) References Cited

U.S. PATENT DOCUMENTS

2015/0217336 A1* 8/2015 Seidel ..... B21B 45/08 134/15

FOREIGN PATENT DOCUMENTS

JP S59171761 * 11/1984
JP S59171761 U 11/1984
(Continued)

OTHER PUBLICATIONS

JPS59171761 translation (Year: 2021).*
International Search Report from PCT/EP2018/081292 dated Feb. 12, 2019.

*Primary Examiner* — Robert S Jones, Jr.
*Assistant Examiner* — Jiangtian Xu
(74) *Attorney, Agent, or Firm* — Abelman, Frayne & Schwab

(57) ABSTRACT

The invention relates to a method for cooling a metallic item (1) by discharging a cooling medium from a cooling bar (2) onto the item (1), wherein the cooling medium is discharged through a slot (3) in the cooling bar (2). According to the invention, in order to achieve improved cooling, during the cooling process the width (B) of the slot (3) in the conveying direction (F) of the item (1) or of the cooling bar (2) is altered in order to bring the cooling power of the cooling medium to a desired or predefined level by open-loop or closed-loop control. In addition, the invention relates to a cooling bar.

6 Claims, 2 Drawing Sheets

(56) References Cited

FOREIGN PATENT DOCUMENTS

| | | | |
|---|---|---|---|
| JP | H03285709 | A | 12/1991 |
| WO | 2014023753 | A1 | 2/2014 |

* cited by examiner

METHOD FOR COOLING A METALLIC ITEM AND COOLING BAR

CROSS REFERENCE TO RELATED APPLICATION

This application claims benefit under 35 U.S.C. § 371 to international application No. PCT/EP2018/081292, filed on Nov. 15, 2018, which claims priority to German application No. DE 102017220891.0, filed on Nov. 22, 2017, the contents of which are incorporated by reference in their entireties.

FIELD OF INVENTION

The invention relates to a method for cooling a metallic item by discharging a cooling medium from a cooling bar onto the item, wherein the cooling medium is discharged through a slot in the cooling bar. The invention further relates to a cooling bar for discharging a cooling medium onto an item to be cooled.

BACKGROUND OF INVENTION

A cooling bar according to the preamble and a method for cooling a metallic item thereby are known from CN 101020196 A for example. A cooling medium (usually water) which is under pressure is guided here through the cooling bar and exits from the cooling bar through a slot (nozzle slot) to reach the item to be cooled. Here, by means of a straight component which can be screwed down on the cooling bar, the desired slot width can be set. However, the slot width then remains fixed during the ongoing process. Variations in the cooling power are then only possible by changing the pressure of the cooling medium. EP 1 420 912 B1 shows a similar solution.

When cooling sheet metal, water is generally applied onto the surface of the metal sheet. In the case of a long metal sheet, the cooling water can simply run off over the edges of the metal sheet. In the case of a uniform application over the width of the metal sheet, this leads to an increase of the volumetric flow rate of the cooling water on the surface of the metal sheet toward the edges of the metal sheet. This leads to a nonuniform cooling action or cooling down. Moreover, a process-caused inhomogeneity in the temperature profile can occur. Both lead to nonuniform mechanical properties and unevenness of the metal sheet.

Although in the previously above disclosed solutions the nozzle geometry can in fact be adjusted, this setting cannot be altered during ongoing operation. It is therefore impossible to react to changing process parameters.

Thus, a drawback in the known solution is that no possibility exists for varying the cooling power beyond the above-disclosed extent during the process. This applies particularly also in reference to the setting of the volume flow of the cooling medium in a direction transverse to the conveying direction of the metallic item (or of the cooling bar, if said cooling bar is moved relative to the item to be cooled).

Therefore, the aim underlying the invention is to provide a method of the type mentioned at the start as well as a cooling bar which makes it possible to allow an optimal setting of the cooling power at desired or required boundary conditions, wherein it should be possible to carry out said setting rapidly and during the process. To that extent, the cooling should be improved.

SUMMARY OF INVENTION

The achievement of this aim by the invention is characterized in terms of method in that during the cooling process the width of the slot in conveying direction of the item or of the cooling bar (if said cooling bar is moved relative to the item) is altered in order to bring the cooling power of the control medium to a desired or predefined level by open-loop or closed-loop control.

In particular, it is provided here that the slot is delimited by at least two sections of the cooling bar, wherein the at least two sections can be moved relative to one another in a feed direction.

The width of the slot in a direction transverse to the conveying direction and perpendicular to the outlet direction of the cooling medium can here also be altered differently in sections according to a development of the invention.

When viewed perpendicularly to the outlet direction of the cooling medium, the two sections of the cooling bar can have a nonlinear course here. Here, it is provided in particular that, when viewed perpendicularly to the outlet direction of the cooling medium, the two sections of the cooling bar in each case have a concave portion and adjoiningly thereto a convex portion. In this case, it is preferably provided that, for the purpose of setting the nozzle gap, the at least two sections of the cooling bar can be shifted in a direction perpendicular to the outlet direction of the cooling medium and perpendicular to the conveying direction (that is to say in a direction transverse to the conveying direction) in order to alter the width of the slot.

In the process, the width of the slot can be set so that the width is greater in a central area of the item to be cooled than in the lateral end areas of the item to be cooled.

The proposed cooling bar for discharging a cooling medium onto an item to be cooled is characterized according to the invention in that electrical, pneumatic or hydraulic adjustment means are present, by means of which the width of the slot in the conveying direction (of the item or of the cooling bar) can be altered.

The adjustment means can here be in connection with an open-loop control, wherein at least one sensor in connection with the open-loop control is arranged, by means of which a physical property of the item can be determined.

The slot is preferably delimited by at least two sections of the cooling bar, wherein the at least two sections of the cooling bar, when viewed perpendicularly to the outlet direction of the cooling medium, have a nonlinear course, preferably an S-shaped course.

The proposed design or the proposed cooling bar is suitable for plate mills, in hot strip mills and in heat treatment lines in particular for steel materials. However, a use for nonferrous metals is likewise possible. In particular, a use in quenching lines with slotted-nozzle cooling bars for cooling water application is also possible.

Thus, a cooling bar with a slotted nozzle and a nozzle geometry which can be altered over the width is provided. Thereby, using defined specifications, the nozzle geometry can be influenced in a targeted manner, in particular during the cooling process itself.

Thus, the present invention provides cooling bars with slotted nozzles, wherein the nozzle geometry and thus the volume flow over the width of the item to be cooled can be altered during ongoing operation. Thus, a closed-loop control system can be implemented, which provides specifications for a designated actuator.

Preferably, the slotted nozzle of the proposed cooling bar consists of at least two portions, wherein at least one portion of the nozzle is designed to be movable. The alteration of the slot geometry can occur, for example, via a closing off of one nozzle portion in the direction of the other nozzle portion. This closing off can occur nonuniformly over the nozzle width. Thus, for example, less cooling water can be applied toward the edges. This helps eliminate the aforementioned drawback.

Another possibility consists in providing the nozzle portions with a special contour, in particular an S-shaped geometry, and then altering the nozzle slot via an axial shifting of the portions with respect to one another.

The adjustment of the slot can here occur manually or automatically. An actuator is provided for an automatic slot adjustment and the resulting possible variable water application over the width of the metal sheet. This actuator preferably receives the specific adjustment values from an automation system (closed-loop control system). The automation system receives information on the dimensions of the metal sheet and the material characteristic (primary data), target properties (hardness, strength, etc.), data from process sensors (material temperatures, actual evenness, etc.), before, in and after the cooling device, and achieved actual properties after the process. With this information, the system is able to transmit adjustment values to the actuator. By means of this continuous backflow of the actual properties, it is possible to select the values so that a homogeneous distribution of the properties of the metal sheet in particular over the width is set. However, it is also possible to set different properties in a targeted manner over the width of the metal sheet.

It is possible (in spite of filters in the intakes of the cooling bars) that blockages or deposits on cooling water nozzles repeatedly occur. By means of the adjustment of the nozzle gap of the slotted nozzle, the nozzle gap can be opened, whereby dirt particles, for example, in the form of clumps or small plates can be rinsed out of the slot.

The proposed solution makes it possible to variably set or adjust the geometry of a slotted nozzle. This adjustment can also occur during ongoing operation during the cooling of an item (metal sheet). Thereby, it is possible to deliver a different water application to the metal sheet head or metal sheet foot.

Moreover, a closed-loop control can be provided, which, depending on different process and specification values, specifies target values for the open-loop control of the nozzle geometry.

By these measures, a better evenness and optimized material properties can be achieved during the cooling process.

By means of the proposed solution, it is possible to control the cooling medium which is running off laterally in a targeted manner so that a desired cooling over the width of a strip occurs. Thus, in particular, a uniform cooling over the strip width can be achieved.

BRIEF DESCRIPTION OF THE DRAWINGS

In the drawing, an embodiment example of the invention is represented. In the drawing.

DETAILED DESCRIPTION OF THE INVENTION

Figure 1:
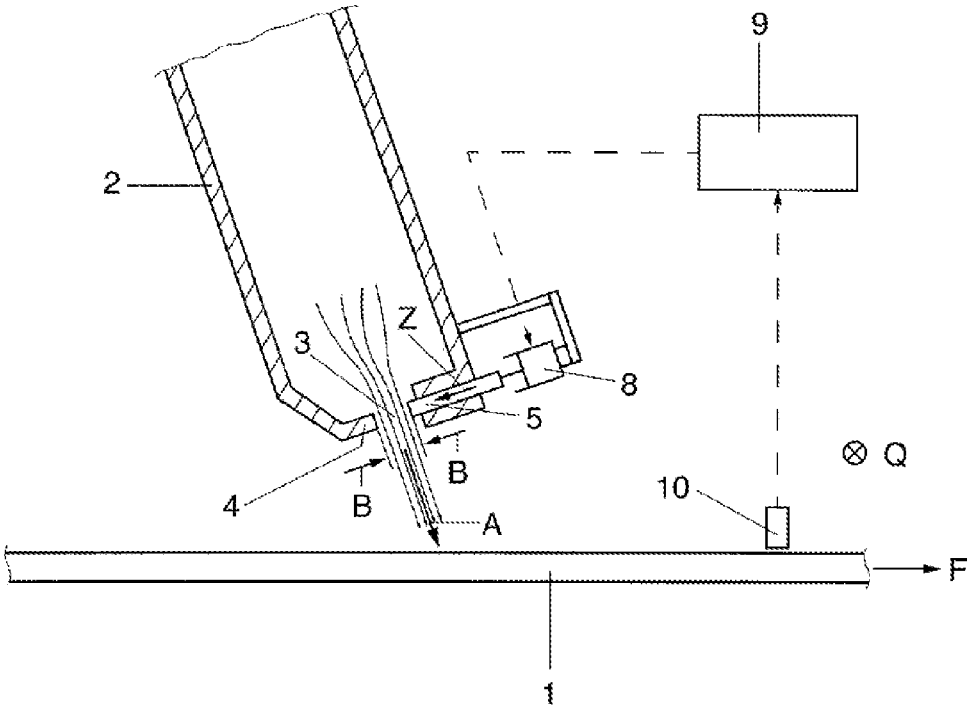
FIG. 1 diagrammatically shows the side view of a cooling bar, represented in cross section, which cools a metallic item running by in the conveying direction.

In FIG. 1, a cooling bar 2 can be seen, under which a metallic item 1 in the form of a metal strip extends in the conveying direction F and is cooled by cooling medium discharged by the cooling bar 2. The horizontal direction Q transverse to the conveying direction F is perpendicular to the plane of the drawing in FIG. 1.

In a manner known per se, the cooling bar 2 has a slot 3 extending over the entire width of the metallic item 2, that is to say in the direction Q, and here—when measured in the conveying direction F—has a width B.

As can be seen in FIG. 1, the outlet direction A of the cooling medium is arranged at a certain angle relative to the surface of the item 1, which, however, does not change the fact that the width B extends over a certain distance in the conveying direction F.

It is essential that the slot 3 of the cooling bar 2 can be altered during the cooling process with respect to its width B, and for that purpose adjustment means 8 are provided. In FIG. 1, they are indicated only schematically and they can be of any type (electric, pneumatic, hydraulic).

By means of said adjustment means, two sections 4 and 5 of the cooling bar 2 can be moved or adjusted relative to one another, i.e., one of the sections, section 5 in the embodiment example, is moved in a feed direction Z in order to set the width B of the slot 3.

In FIG. 1, it is indicated that a physical variable (this can be the planarity of the item 1 or its temperature) is acquired by means of a sensor 10, and the measured value is supplied to an open-loop control 9. Said open-loop control, based on an algorithm stored in it, can then deliver a control signal to the adjustment means 8, by means of which a certain width B is set, so that a desired property of the item 1 can be achieved. Thus, in the closed control loop it can be ensured that the width B of the slot 3 of the cooling bar is set so that a desired property of the item 1 results.

Figure 2A:
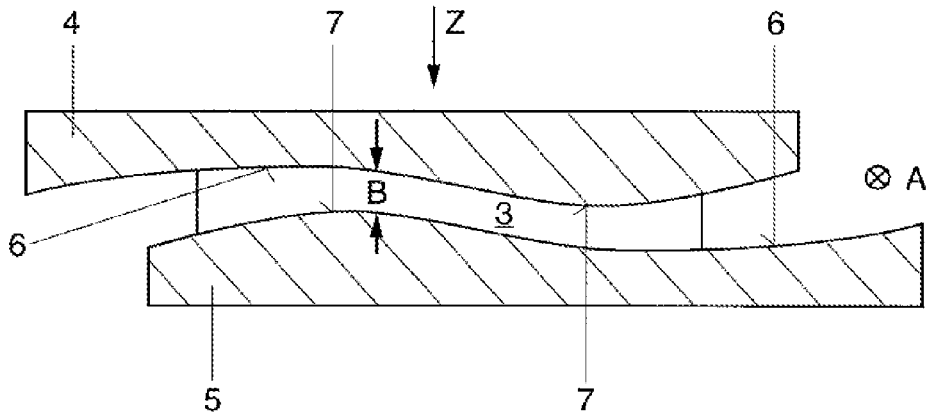
FIG. 2*a* shows the slot of the cooling bar, when viewed in outlet direction of the cooling medium, in a first relative position of two sections of the cooling bar.
Figure 2B:
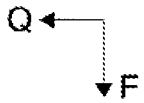
FIG. 2*b* shows the slot of the cooling bar according to FIG. 2*a* in a second shifted relative position of the sections of the cooling bar.

A special and preferred design of the sections 4 and 5 of the cooling bar 2 can be seen in FIGS. 2*a* and 2*b*.

When viewed in outlet direction A of the cooling medium, which in FIGS. 2*a* and 2*b* is perpendicular to the plane of the drawing, the two sections 4, 5 have concave portions 6 and convex portions 7, so that the represented S-shaped course of the delimitation of the slot 3 results.

Figure 2B:
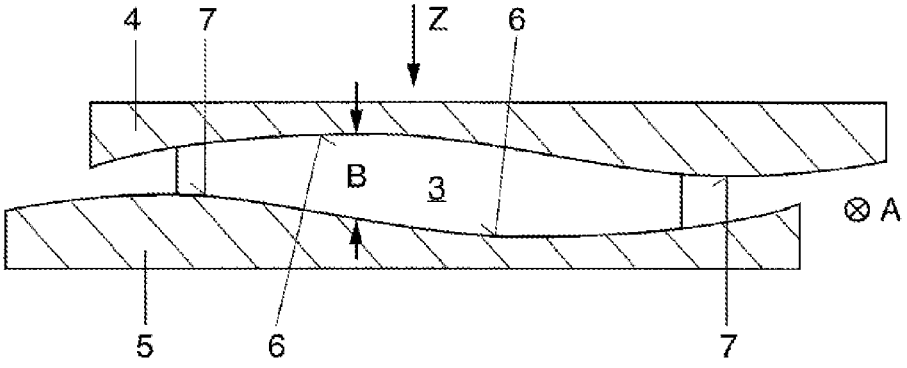

While in FIG. 2*a* the two sections 4 and 5 are located in a starting position and the slot 3 here has a largely constant (albeit curved) width B, in FIG. 2*b* the two sections 4 and 5 are shifted relative to one another in direction Q (in FIG. 2 the upper section 4 has been shifted to the right and the lower section 5 to the left). Accordingly, the form of the slot 3 has been altered.

As can be seen in FIG. 2*b*, in the central area of the item to be cooled, due to the larger width B of the slot 3, more cooling medium reaches the item, while in the two lateral areas of the metal sheet 1 or end areas of the slot 3, a smaller width is present and thus less cooling medium exits.

By a corresponding shifting of the two sections 4 and 5 in direction Q, the quantity and the distribution of the exiting cooling medium can thus be influenced and thereby the cooling process can be controlled by open-loop or closed-loop control.

In particular this occurs actively during the cooling process, so that an influence on changing circumstances with regard to the process can be obtained by influencing the cooling.

LIST OF REFERENCE NUMERALS

1 Metallic item
2 Cooling bar
3 Slot in the cooling bar
4 Section of the cooling bar
5 Section of the cooling bar
6 Concave portion
7 Convex portion
8 Adjustment means
9 Open-loop control
10 Sensor
B Width of the slot
F Conveying direction of the item/of the cooling bar
Z Feed direction
Q Direction transverse to the conveying direction
A Outlet direction of the cooling medium

What is claimed is:

1. A method for cooling a metallic item by discharging a cooling medium from a cooling bar onto the metallic item, wherein the cooling medium is discharged through a slot in the cooling bar, wherein during a cooling process a width of the slot in a conveying direction of the metallic item or of the cooling bar is altered in order to bring a cooling power of the cooling medium to a desired or predefined level by open-loop or closed-loop control, wherein the width of the slot in a direction both transverse to the conveying direction and perpendicular to an outlet direction of the cooling medium is altered differently in sections, wherein the slot is delimited by at least two sections of the cooling bar, wherein the two sections of the cooling bar, when viewed perpendicularly to the outlet direction of the cooling medium, each have a concave portion and adjoiningly thereto a convex portion, and wherein the at least two sections of the cooling bar are shifted in a direction that is both perpendicular to the outlet direction of the cooling medium and perpendicular to the conveying direction in order to alter the width of the slot.

2. The method according to claim 1, wherein the width of the slot is set so that the width is greater in a central area of the metallic item to be cooled than at lateral end areas of the metallic item to be cooled.

3. The method according to claim 1, wherein each one of the two sections of the cooling bar, when viewed perpendicularly to the outlet direction of the cooling medium, have the concave portion and the adjoiningly convex portion to define an S-shaped profile.

4. The method according to claim 1, further comprising altering the width of the slot in the first conveying direction by at least one of electrical, pneumatic and hydraulic adjustment means.

5. The method according to claim 4, wherein the adjustment means is in connection with the open-loop control, wherein at least one sensor in connection with the open-loop control is arranged, from which a physical property of the metallic item can be determined.

6. The method according to claim 4, wherein the adjustment means is an actuator in connection with the closed-loop control, wherein at least one sensor in connection with the closed-loop control is arranged, from which a physical property of the metallic item can be determined, and the at least two sections of the cooling bar are automatically adjusted by the actuator in response to signals from the at least one sensor during a rolling operation.

* * * * *